US011359304B2

(12) United States Patent
Chang et al.

(10) Patent No.: US 11,359,304 B2
(45) Date of Patent: Jun. 14, 2022

(54) POWDER SUPPLY APPARATUS AND PLATING SYSTEM

(71) Applicant: EBARA CORPORATION, Tokyo (JP)

(72) Inventors: Shao Hua Chang, Tokyo (JP); Jumpei Fujikata, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 592 days.

(21) Appl. No.: 16/234,299

(22) Filed: Dec. 27, 2018

(65) Prior Publication Data

US 2019/0203374 A1 Jul. 4, 2019

(30) Foreign Application Priority Data

Dec. 28, 2017 (JP) ..... JP2017-253017

(51) Int. Cl.

| | |
|---|---|
| ***C25D 21/16*** | (2006.01) |
| ***C25D 21/18*** | (2006.01) |
| ***C25D 17/00*** | (2006.01) |
| ***C25D 21/14*** | (2006.01) |
| ***C25D 17/02*** | (2006.01) |

(52) U.S. Cl.

CPC ..... *C25D 21/16* (2013.01); *C25D 17/00* (2013.01); *C25D 17/02* (2013.01); *C25D 21/14* (2013.01); *C25D 21/18* (2013.01)

(58) Field of Classification Search

CPC ..... C25D 21/14; C25D 21/16; C25D 21/18; C25C 3/14

See application file for complete search history.

(56) References Cited

U.S. PATENT DOCUMENTS 6,176,647 B1 * 1/2001 Itoh ..... B05B 5/1683 406/14
2013/0048508 A1 * 2/2013 Wedde ..... C25C 3/22 205/391

FOREIGN PATENT DOCUMENTS

| | | | | |
|---|---|---|---|---|
| EP | 1462530 A1 * | 9/2004 | ..... | C22B 9/05 |
| JP | 06192897 A * | 7/1994 | ..... | G02B 6/0023 |
| JP | 2012-116611 A | 6/2012 | | |
| JP | 2014-118215 A | 6/2014 | | |
| JP | 2017-141503 A | 8/2017 | | |

* cited by examiner

*Primary Examiner* — Ciel P Contreras
(74) *Attorney, Agent, or Firm* — BakerHostetler

(57) ABSTRACT

There is provided a powder supply apparatus that prevents powder from scattering as much as possible. There is provided the powder supply apparatus that supplies a powder containing a metal used for a plating to a plating solution. This powder supply apparatus includes a plating solution tank, a feed pipe, a gas supply line, and a spiral-air-flow-generating component. The plating solution tank is configured to house the plating solution. The feed pipe is configured to feed the powder into the plating solution tank. The gas supply line is configured to supply a gas. The spiral-air-flow-generating component is configured to receive the gas from the gas supply line to generate a spiral air flow heading toward the plating solution tank inside the feed pipe.

7 Claims, 11 Drawing Sheets

POWDER SUPPLY APPARATUS AND PLATING SYSTEM

CROSS-REFERENCE TO RELATED APPLICATION

This application is based upon and claims benefit of priority from Japanese Patent Application No. 2017-253017 filed on Dec. 28, 2017, the entire contents of which are incorporated herein by reference.

TECHNICAL FIELD

The present invention relates to a powder supply apparatus and a plating system.

BACKGROUND ART

Conventionally, wiring is formed on fine grooves for wiring, holes, or resist openings disposed on a surface of a substrate such as a semiconductor wafer, and bumps (protruding electrode) electrically connected to electrodes or similar parts of a package are formed on the surface of the substrate. As such method for forming these wiring and bumps, for example, an electrolytic plating method, a deposition method, a printing method, and a ball bump method have been known. Meanwhile, in accordance with an increase in the number of I/Os of a semiconductor chip and a decrease in pitch, the electrolytic plating method that allows miniaturization and provides comparatively stable performance has been often used.

In an apparatus performing the electrolytic plating, an anode and a substrate are generally disposed so as to be mutually opposed in a plating bath that houses plating solution, and a voltage is applied to the anode and the substrate. This forms a plating film on the substrate surface.

As the anode used by the electrolytic plating apparatus, there has been conventionally used a soluble anode, which dissolves in plating solution, or an insoluble anode, which does not dissolve in the plating solution. In a plating process using the insoluble anode, metal ions in the plating solution are consumed as the plating progresses. In view of this, it is necessary to regularly supplement the metal ions to the plating solution and adjust the concentration of the metal ions in the plating solution. Therefore, there has been known an apparatus that dissolves metallic powder in plating solution housed in a plating solution tank different from plating baths and supplies the plating solution to the plating baths (for example, see PTL 1).

CITATION LIST

Patent Literature

PTL 1: Japanese Unexamined Patent Application Publication No. 2017-141503

SUMMARY OF INVENTION

Technical Problem

Conventionally, when a metallic powder is fed to a plating solution tank, the powder scatters around the outside of the apparatus, possibly resulting in contamination of a clean room. To prevent the contamination of the clean room, the conventional apparatus is installed at a space different from the clean room, for example, a downstairs room of the clean room or the like. However, when it is not possible to prepare the space different from the clean room or similar situation, the apparatus is desired to be installed in the clean room. Additionally, even when the scatter of the powder remains inside the apparatus, a problem arises in that the scattered powder fails to be fed to the plating solution tank and therefore becomes wasteful.

The present invention has been made in consideration of the above-described problems and one object of the present invention is to provide a powder supply apparatus that prevents powder from scattering as far as possible.

Solution to Problem

According to one aspect of the present invention, there is provided a powder supply apparatus that supplies a powder containing a metal used for a plating to a plating solution. This powder supply apparatus includes a plating solution tank, a feed pipe, a gas supply line, and a spiral-air-flow-generating component. The plating solution tank is configured to house the plating solution. The feed pipe is configured to feed the powder into the plating solution tank. The gas supply line is configured to supply a gas. The spiral-air-flow-generating component is configured to receive the gas from the gas supply line to generate a spiral air flow heading toward the plating solution tank inside the feed pipe.

According to another aspect of the present invention, there is provided a powder supply apparatus that supplies a powder containing a metal used for a plating to a plating solution. This powder supply apparatus includes a plating solution tank, a feed pipe, and a curtain generating component. The plating solution tank is configured to house the plating solution. The feed pipe is configured to feed the powder into the plating solution tank. The curtain generating component generates a tubular curtain of the plating solution so as to cover an outlet of the feed pipe.

According to another aspect of the present invention, there is provided a powder supply apparatus that supplies a powder containing a metal used for a plating to a plating solution. This powder supply apparatus includes a plating solution tank and a hopper. The plating solution tank is configured to house the plating solution. The hopper houses the powder. The hopper includes a feed port and an exhaust port. The feed port is configured to feed the powder into the hopper. The exhaust port discharges a gas in the hopper. The powder supply apparatus further includes a first scatter preventing component and a second scatter preventing component. The first scatter preventing component is configured to prevent the powder from scattering from a clearance between the feed port and a feed nozzle. The feed nozzle is configured to feed the powder to the feed port. The second scatter preventing component is configured to prevent the powder from scattering from the exhaust port.

According to another aspect of the present invention, there is provided a plating system. This plating system includes the powder supply apparatus, a plating bath, and a plating solution supply pipe. The powder supply apparatus is according to any one of the above-described powder supply apparatuses. The plating bath is configured to plate a substrate. The plating solution supply pipe extends from the plating solution tank of the powder supply apparatus to the plating bath.

DESCRIPTION OF EMBODIMENTS

Figure 1:
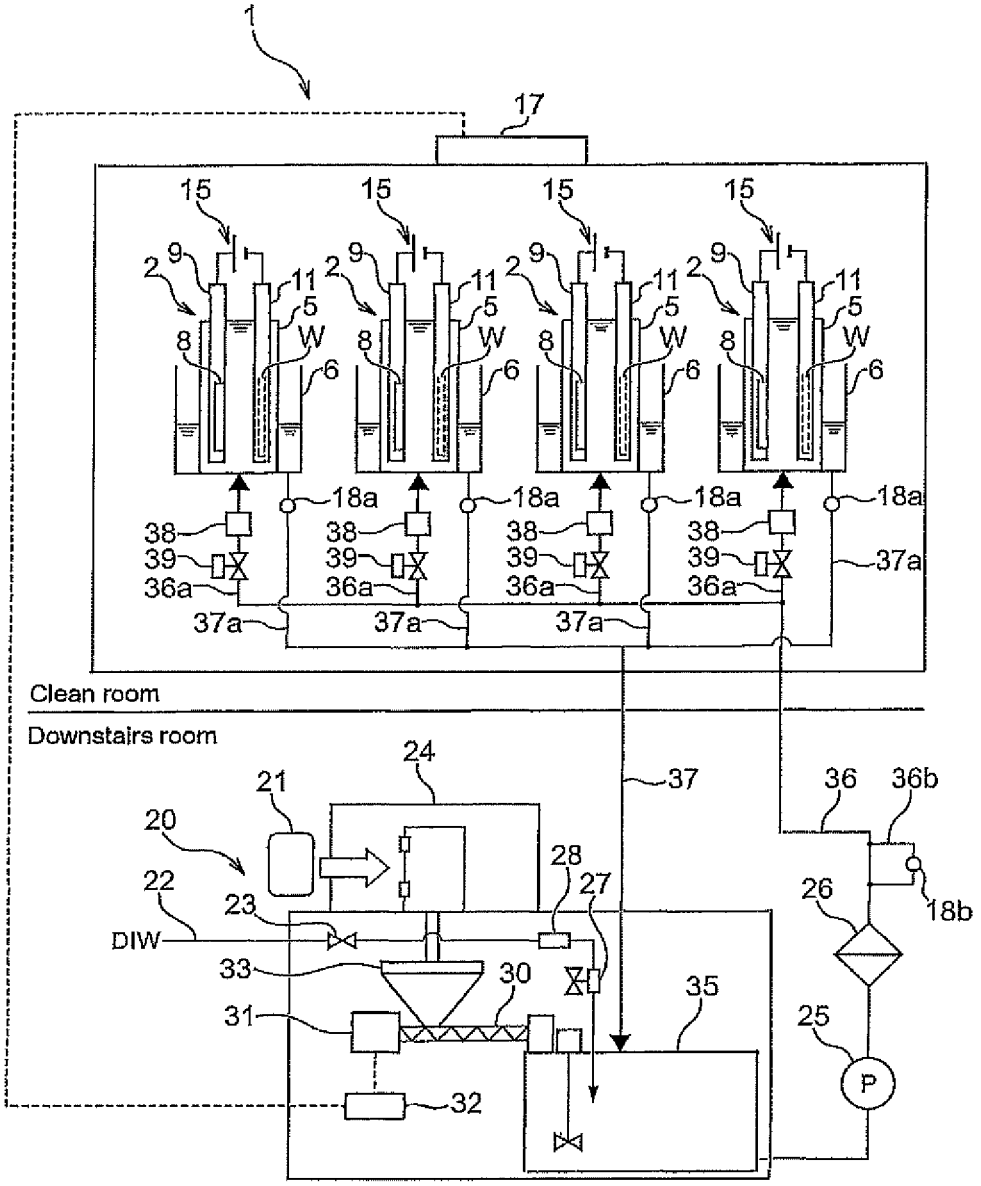
FIG. 1 is a schematic diagram illustrating an entire plating system according to an embodiment.

The following describes an embodiment of the present invention with reference to the drawings. In the drawings described later, the identical reference numerals are used for the identical or equivalent components, and therefore such components will not be further elaborated here. FIG. 1 is a schematic diagram illustrating an entire plating system according to this embodiment. The plating system includes a plating apparatus 1 installed in a clean room and a powder supply apparatus 20 installed in a downstairs room. The powder supply apparatus 20 of this embodiment may be installed in the clean room similarly to the plating apparatus 1.

In this embodiment, the plating apparatus 1 is an electrolytic plating unit to perform electrolytic plating on a metal such as a copper to a substrate such as a wafer, and the powder supply apparatus 20 is an apparatus to supply plating solution used in the plating apparatus 1 with powder containing at least a metal. This embodiment describes an example of using a copper oxide powder as the powder containing at least the metal. The average grain diameter of the copper oxide powder in this embodiment is, for example, from 10 micrometers to 200 micrometers. In this description, "powder" includes a substance with any shape having a possibility of scatter, for example, solid particles, a molded granular matter, a solid material molded into pellet form, a solid material ball formed into a small-grain diameter spherical body, a strip-shaped material formed by molding a solid metal into a ribbon or a tape shape, or a mixture of a combination of any of these materials.

The plating apparatus 1 of this embodiment includes four plating baths 2. The plating apparatus 1 can include any number of the plating baths 2. Each of the plating baths 2 include an inner tank 5 and an outer tank 6. In the inner tank 5, an insoluble anode 8 held to an anode holder 9 is located. In the plating bath 2, a neutral membrane (not illustrated) is located around the insoluble anode 8. The inner tank 5 is filled with plating solution and the plating solution overflown from the inner tank 5 flows into the outer tank 6. Note that the inner tank 5 may be provide with a puddle (not illustrated) that stirs the plating solution. A substrate W is held to a substrate holder 11 and is immersed in the plating solution in the inner tank 5 together with the substrate holder 11. As the substrate W, a semiconductor substrate, a printed wiring board, or similar component is usable.

The insoluble anode 8 is electrically connected to a positive electrode of a plating power supply 15 via the anode holder 9, and the substrate W held to the substrate holder 11 is electrically connected to a negative electrode of the plating power supply 15 via the substrate holder 11. An application of a voltage between the insoluble anode 8 and the substrate W immersed into the plating solution by the plating power supply 15 causes an electrochemical reaction in the plating solution housed in the plating bath 2, thus depositing a copper on the surface of the substrate W. The surface of the substrate W is thus plated with the copper.

The plating apparatus 1 includes a plating control unit 17 that controls the plating process on the substrate W. This plating control unit 17 has a function that calculates a concentration of copper ions contained in the plating solution in the plating bath 2 from an accumulated value of a current flowing through the substrate W. Specifically, as the plating on the substrate W progresses, the copper in the plating solution is consumed. The amount of consumed copper is proportionate to the accumulated value of the current flowing through the substrate W. The plating control unit 17 can calculate the copper ion concentration in the plating solution in each plating bath 2 from the amount of copper fed to the plating solution and the accumulated value of the current (amount of consumed copper).

The powder supply apparatus 20 includes a sealing chamber 24, a hopper 33, a feeder 30, a motor 31, a plating solution tank 35, and an operation control unit 32. A powder container 21 housing the copper oxide powder is carried in the sealing chamber 24. The hopper 33 houses the copper oxide powder supplied from the powder container 21. The feeder 30 is configured to convey powder positioned at the lower portion of the hopper 33. The motor 31 serves as a driving source of the feeder 30. The plating solution tank 35 is configured to house the plating solution and receive the copper oxide powder conveyed by the feeder 30. The operation control unit 32 controls the behaviors of the motor 31.

The plating apparatus 1 and the powder supply apparatus 20 are connected with a plating solution supply pipe 36 and a plating solution return pipe 37. More specifically, the plating solution supply pipe 36 extends from the plating solution tank 35 to the bottom portions of the inner tanks 5 in the plating baths 2. The plating solution supply pipe 36 branches into four branch pipes 36*a* connected to the respective bottom portions of the inner tanks 5 in the four plating baths 2. The four branch pipes 36*a* are provided with a flowmeter 38 and a flow rate adjusting valve 39, respectively. The flowmeters 38 and the flow rate adjusting valves 39 are communicatively connected to the plating control unit 17. The plating control unit 17 is configured to control the degree of opening of the flow rate adjusting valve 39 based on the flow rate of the plating solution measured by the flowmeter 38. Accordingly, the respective flow rate adjusting valves 39, which are disposed on the upstream sides of the respective plating baths 2, control the flow rates of the plating solutions supplied to the respective plating baths 2 via the four branch pipes 36*a* such that these flow rates become approximately identical. The plating solution return pipe 37 extends from the bottom portions of the outer tanks 6 of the plating baths 2 to the plating solution tank 35. The plating solution return pipe 37 includes four discharge pipes 37*a* respectively connected to the bottom portions of the outer tanks 6 of the four plating baths 2.

The plating solution supply pipe 36 is provided with a pump 25 to transport the plating solution and a filter 26 located downstream with respect to the pump 25. The plating solution used in the plating apparatus 1 is sent to the plating solution tank 35 of the powder supply apparatus 20 through the plating solution return pipe 37. The plating solution to which the copper oxide powder has been added in the powder supply apparatus 20 is sent to the plating apparatus 1 through the plating solution supply pipe 36. The pump 25 can always circulate the plating solution between the plating apparatus 1 and the powder supply apparatus 20. Alternatively, a predetermined amount of the plating solution may be intermittently sent from the plating apparatus 1 to the powder supply apparatus 20, and the plating solution to which the copper oxide powder has been added may be intermittently returned from the powder supply apparatus 20 to the plating apparatus 1.

Furthermore, to supplement pure water (DIW: De-ionized Water) in the plating solution, a pure water supply line 22 is connected to the plating solution tank 35. In this pure water supply line 22, an opening/closing valve 23 to stop supplying the pure water when the plating apparatus 1 is stopped or similar situation, a flowmeter 28 to measure the flow rate of the pure water, and a flow rate adjusting valve 27 to adjust the flow rate of the pure water are located. The opening/closing valve 23 is usually open. The flowmeter 28 and the flow rate adjusting valve 27 are communicatively connected to the plating control unit 17. The plating control unit 17 is configured such that when the copper ion concentration in the plating solution exceeds a set value, the plating control unit 17 controls the degree of opening of the flow rate adjusting valve 27 and supplies the pure water to the plating solution tank 35 for dilution of the plating solution.

The plating control unit 17 is communicatively connected to the operation control unit 32 of the powder supply apparatus 20. The plating control unit 17 is configured such that when the copper ion concentration in the plating solution becomes lower than the set value, the plating control unit 17 transmits a signal indicative of a replenishment request value to the operation control unit 32 in the powder supply apparatus 20. When receiving this signal, the powder supply apparatus 20 adds the copper oxide powder to the plating solution until the additive amount of the copper oxide powder reaches the replenishment request value. While this embodiment configures the plating control unit 17 and the operation control unit 32 as different apparatuses, the plating control unit 17 and the operation control unit 32 may be configured as one control unit in one embodiment. In this case, the control unit may be a computer behaving in accordance with a program. This program may be stored in a storage medium.

The plating apparatus 1 may include concentration measuring devices 18*a* that measure the copper ion concentration in the plating solution. The respective concentration measuring devices 18*a* are mounted to the four discharge pipes 37*a* of the plating solution return pipe 37. The measured value of the copper ion concentration obtained by the concentration measuring device 18*a* is sent to the plating control unit 17. The plating control unit 17 may compare the copper ion concentration in the plating solution calculated from the accumulated value of the current with the above-described set value or may compare the copper ion concentration measured by the concentration measuring device 18*a* with the above-described set value. The plating control unit 17 may calibrate the calculated value of the copper ion concentration based on the comparison between the copper ion concentration (that is, the calculated value of the copper ion concentration) in the plating solution calculated from the accumulated value of the current and the copper ion concentration (that is, the measured value of the copper ion concentration) measured by the concentration measuring device 18*a*.

A branch pipe 36*b* may be disposed at the plating solution supply pipe 36, and a concentration measuring device 18*b* may be disposed at this branch pipe 36*b* to monitor the copper ion concentration in the plating solution. Alternatively, an analyzer (for example, a CVS device and a colorimeter) may be disposed at this branch pipe 36*b* to quantitatively analyze and monitor dissolved concentrations of various chemical compositions in addition to the dissolved concentration of the copper ion. This allows analyzing a concentration of a chemical composition, for example, impurities in the plating solution present in the plating solution supply pipe 36 before the plating solution is supplied to the respective plating baths 2. Consequently, this prevents the impurities from affecting plating performance, thereby ensuring further highly accurate plating process. Note that only any one of the concentration measuring devices 18*a* and 18*b* may be disposed.

Figure 2:
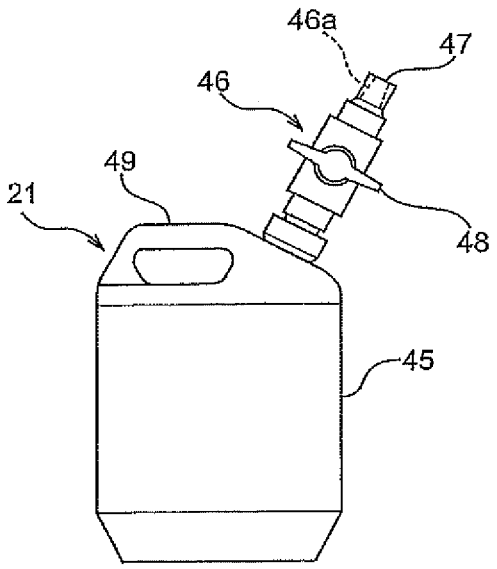
FIG. 2 is a side view illustrating a powder container that can internally hold a copper oxide powder.

FIG. 2 is a side view illustrating the powder container 21 that can internally hold the copper oxide powder. As illustrated in FIG. 2, the powder container 21 includes a container body 45 that can internally house the copper oxide powder, a powder conduit 46 (equivalent to one example of a feed nozzle) connected to the container body 45, and a valve 48 mounted to the powder conduit 46. The container body 45 is made of synthetic resin such as polyethylene. A handle 49 is formed at the container body 45 such that a worker can carry around the powder container 21 by grasping the handle 49.

The powder conduit 46 is joined to the container body 45. This powder conduit 46 is inclined at an angle of about 30 degrees with respect to the vertical direction. Opening the valve 48 mounted to the powder conduit 46 can cause the copper oxide powder to pass through the powder conduit 46, and closing the valve 48 renders the copper oxide powder incapable of passing through the powder conduit 46. FIG. 2 illustrates the closed valve 48. The powder conduit 46 includes a nozzle 46*a* at the tip. A cap 47 is mounted to the nozzle 46*a*.

Figure 3:
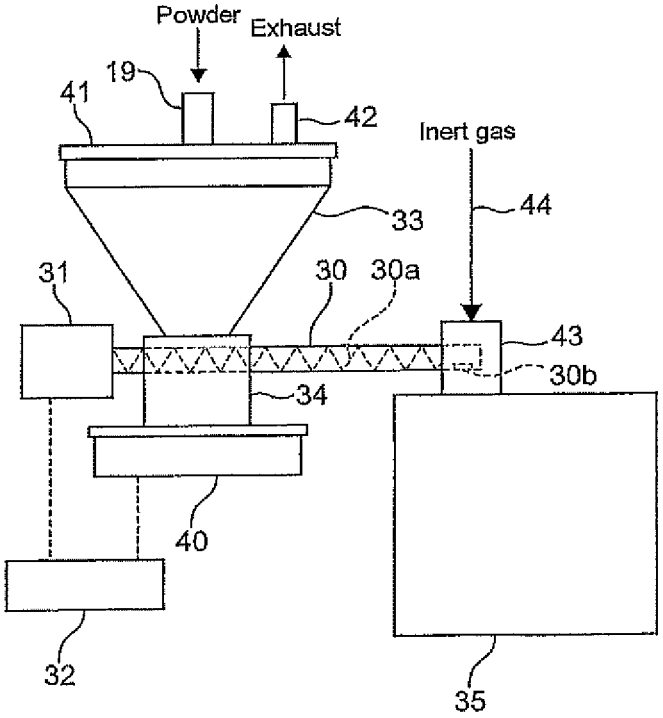
FIG. 3 is a side view illustrating a part of a powder supply apparatus.

Next, the following describes the powder supply apparatus 20 illustrated in FIG. 1 in detail. FIG. 3 is a side view illustrating a part of the powder supply apparatus 20. The drawing omits the sealing chamber 24 in the powder supply apparatus 20. As illustrated in the drawing, the hopper 33 is a reservoir for powder that internally houses the copper oxide powder supplied from the powder container 21. The hopper 33 entirely has a truncated cone shape such that the copper oxide powder is likely to flow downward. The hopper 33 has an upper end opening covered with a lid 41. The lid 41 includes a feed port 19 to which the copper oxide powder is fed from the above-described powder container 21 and an exhaust port 42. This exhaust port 42 communicates with an internal space of the hopper 33 and is connected to a negative-pressure source (not illustrated). Accordingly, the gas in the hopper 33 is discharged through the exhaust port 42.

The feeder 30 communicates with an opening disposed on the lower portion of the hopper 33. The feeder 30 is configured to supply the powder from the opening on the lower portion of the hopper 33 to a feed pipe 29 (see FIG. 4) described later. While the feeder 30 is a screw feeder including a screw 30*a* in this embodiment, the configuration is not limited to this and any conveyance apparatus is employable. The motor 31 is connected to the feeder 30 and configured to drive the feeder 30. The hopper 33 and the feeder 30 are fixed to a bracket 34, and further the bracket 34 is supported to a weight measuring device 40. That is, the weight measuring device 40 is configured to measure the total weight of the hopper 33, the feeder 30, the motor 31, and the copper oxide powder present inside the hopper 33 and the feeder 30.

An outlet 30*b* of the feeder 30 is surrounded by an enclosure cover 43. Driving the feeder 30 by the motor 31 conveys the copper oxide powder in the hopper 33 into the enclosure cover 43 by the feeder 30 and causes the copper oxide powder to fall into the plating solution tank 35. The outlet 30*b* of the feeder 30 is positioned in the enclosure cover 43. The powder supply apparatus 20 includes an inert gas supply line 44 (equivalent to one example of a gas supply line). The inert gas supply line 44 passes through the enclosure cover 43 and is connected to a spiral-air-flow-generating component 50 (see FIG. 4) described later.

The weight measuring device 40 is communicatively connected to the operation control unit 32, which controls the behaviors of the motor 31. The measured value of the weight output from the weight measuring device 40 can be transmitted to the operation control unit 32. The operation control unit 32 receives the signal indicative of the replenishment request value transmitted from the plating apparatus 1 (see FIG. 1) and operates the motor 31 until the additive amount of the copper oxide powder reaches the replenishment request value. The motor 31 drives the feeder 30, and the feeder 30 adds the copper oxide powder by the amount corresponding to the replenishment request value to the plating solution tank 35.

In the powder supply apparatus 20 illustrated in FIG. 3, the weight of the feeder 30 is measured by the weight measuring device 40 as described above. In view of this, a part near the outlet 30*b* of the feeder 30 is configured so as not to contact the enclosure cover 43. That is, a clearance is formed between the part near the outlet 30*b* of the feeder 30 and the enclosure cover 43. When the copper oxide powder falls from the outlet 30*b* of the feeder 30 to the plating solution tank 35, the copper oxide powder possibly scatters from this clearance. The powder supply apparatus 20 according to this embodiment has a configuration of reducing this scatter.

Figure 4:
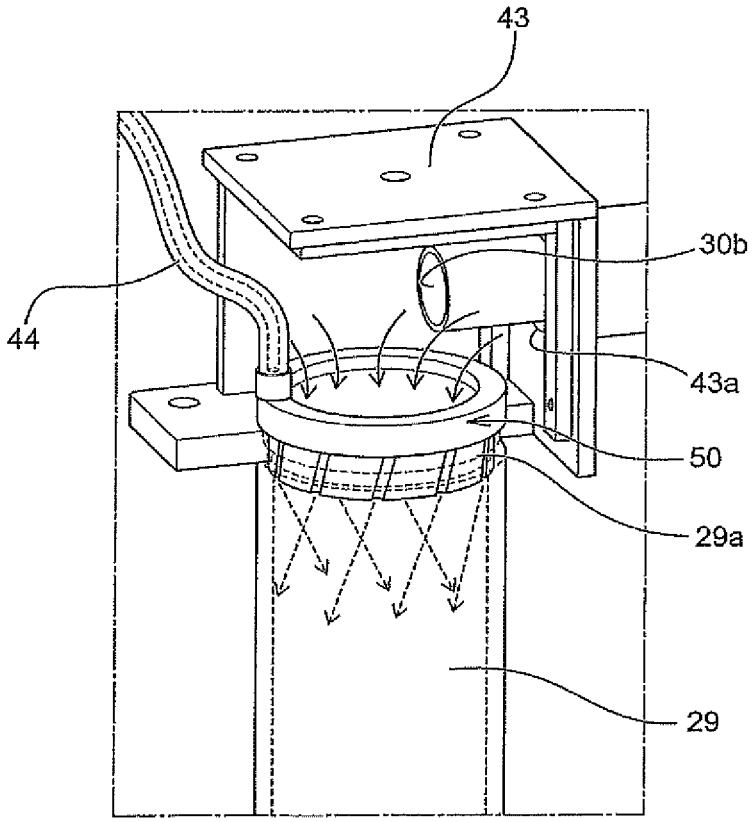
FIG. 4 is an enlarged perspective view of an inside of an enclosure cover illustrated in FIG. 3.

FIG. 4 is an enlarged perspective view of the inside of the enclosure cover 43 illustrated in FIG. 3. As illustrated in FIG. 4, the enclosure cover 43 has an opening 43*a* into which the feeder 30 is inserted at the side portion. Since the feeder 30 does not contact the enclosure cover 43, the copper oxide powder possibly scatters from a clearance between this opening 43*a* and the feeder 30. The powder supply apparatus 20 includes the feed pipe 29 that vertically extends from the inside of the enclosure cover 43 to the plating solution tank 35 illustrated in FIG. 1 and FIG. 3. The feed pipe 29 is preferably made of an ultra high molecular weight polyethylene material that prevents charging. The feed pipe 29 has an inlet open end 29*a* to which the powder is fed and an outlet open end 29*b* (see FIG. 6 described later) from which the powder comes out. As illustrated in FIG. 4, the inlet open end 29*a* is located so as to be open upward. Accordingly, the copper oxide powder conveyed by the feeder 30 falls from the outlet 30*b* of the feeder 30 and is fed into the plating solution tank 35 through the feed pipe 29.

To reduce the scatter of the copper oxide powder, this embodiment includes the spiral-air-flow-generating component 50 configured to generate a spiral air flow in the feed pipe 29. The spiral-air-flow-generating component 50 receives the inert gas from the inert gas supply line 44 and generates the spiral air flow heading toward the plating solution tank 35.

Figure 5A:
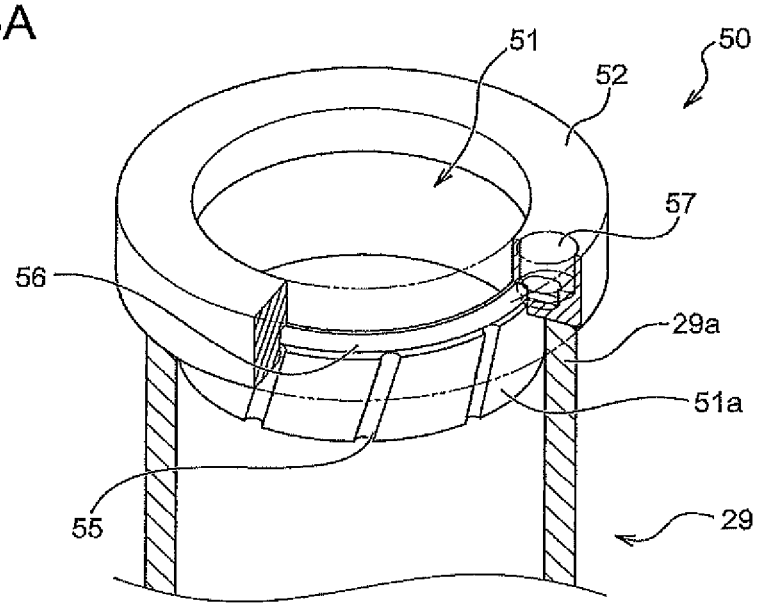
FIG. 5A is a perspective view of a spiral-air-flow-generating component.
Figure 5B:
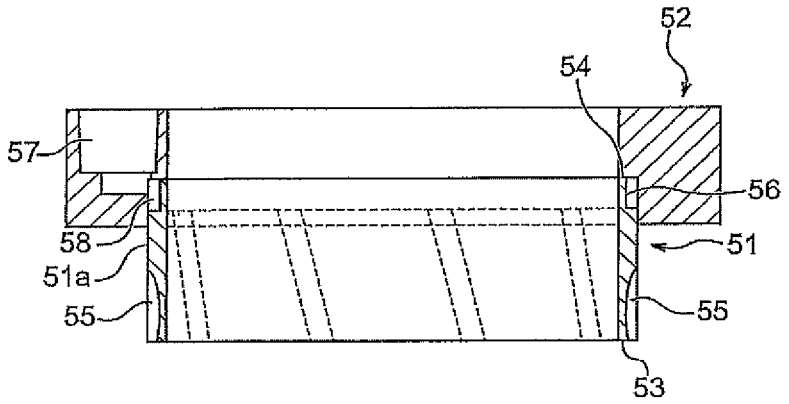
FIG. 5B is a cross-sectional side view of the spiral-air-flow-generating component.

FIG. 5A is a perspective view of the spiral-air-flow-generating component 50. FIG. 5B is a cross-sectional side view of the spiral-air-flow-generating component 50. As illustrated in FIG. 5A, the spiral-air-flow-generating component 50 is mounted to the inlet open end 29*a* of the feed pipe 29. As illustrated in FIG. 5A and FIG. 5B, the spiral-air-flow-generating component 50 includes an approximately cylindrical-shaped tubular member 51 and an annular member 52 mounted to the tubular member 51 or integrally formed with the tubular member 51. FIG. 5A illustrates the annular member 52 and the feed pipe 29 in cross section.

As illustrated in FIG. 5A, with the spiral-air-flow-generating component 50 mounted to the feed pipe 29, an outer surface 51*a* of the tubular member 51 is configured to contact the inner surface of the feed pipe 29. The tubular member 51 has a first end 53 (lower end in the drawing) positioned on the plating solution tank 35 side and a second end 54 (upper end in the drawing) on the side opposite to the first end 53. In this embodiment, the tubular member 51 is partially inserted into the feed pipe 29, and the second end 54 is located so as to project from the feed pipe 29.

The tubular member 51 has one or more grooves 55 extending from the first end 53 to the second end 54 on the outer surface 51*a*. In other words, the grooves 55 reach at least the first end 53 and do not need to reach the second end 54. In this embodiment, the plurality of grooves 55 are formed on the outer surface 51*a*. As illustrated in the drawing, the grooves 55 are configured to be inclined with respect to the axial direction of the tubular member 51. The grooves 55 are each configured to be inclined at the identical angle to one another. Note that the angles, the widths, and the depths of the grooves 55 are desirable to be appropriately set according to the inner diameter, the length, or similar specification of the feed pipe 29. Partially inserting the tubular member 51 into the feed pipe 29 defines a plurality of flow passages inclined with respect to the axial direction of the tubular member 51 by the grooves 55 of the tubular member 51 and the inner surface of the feed pipe 29.

Furthermore, the tubular member 51 has a circumferentially-extending circumferential stepped portion 56. In this embodiment, the circumferential stepped portion 56 is formed on the second end 54 of the tubular member 51. Accordingly, the tubular member 51 and the annular member 52 define a gas flow passage 58 (see FIG. 5B), which communicates with the grooves 55, in the circumferential direction. The annular member 52 has a gas injection port 57 to which the inert gas supply line 44 is connected on the top surface (the surface on the upper side in the drawing). The gas injection port 57 communicates with the gas flow passage 58 in the circumferential direction of the tubular member 51.

Next, the following describes the function of the spiral-air-flow-generating component 50. When the inert gas is supplied from the inert gas supply line 44 to the gas injection port 57, the inert gas passes through the gas flow passage 58 of the circumferential direction and reaches the plurality of respective grooves 55. This ensures the uniformed pressure of the inert gas passing through the grooves 55. The inert gas passes through the grooves 55 and is discharged from the first end 53 of the tubular member 51 into the feed pipe 29. At this time, since the grooves 55 are inclined with respect to the axial direction of the tubular member 51, the inert gas generates an air flow in a spiral pattern (spiral air flow) in the feed pipe 29. The spiral air flow generated in the feed pipe 29 is discharged from the outlet open end 29*b* (see FIG. 6 described later) of the feed pipe 29 while drawing air in the enclosure cover 43 into the feed pipe 29. This allows the copper oxide powder present in the atmosphere in the enclosure cover 43 to be drawn into the feed pipe 29, thereby ensuring reducing the scatter of the copper oxide powder. Additionally, the spiral air flow generated in the feed pipe 29 can prevent the copper oxide powder passing through the inside of the feed pipe 29 from contacting the inner wall surface of the feed pipe 29. This allows preventing the copper oxide powder from attaching to the inner wall surface of the feed pipe 29.

As described above, in this embodiment, since the spiral-air-flow-generating component 50 can generate the spiral air flow in the feed pipe 29, the scatter of the powder in the enclosure cover 43 can be reduced. Additionally, this embodiment can reduce the attachment of the powder to the inside of the feed pipe 29.

In this embodiment, the tubular member 51 has the grooves 55 on the outer surface 51*a* and supplying the gas to these grooves 55 generates the spiral air flow. Accordingly, the spiral air flow can be generated with the spiral-air-flow-generating component 50 of this embodiment by a considerably simple configuration. Further, in this embodiment, the inert gas supply line 44 is connected to the gas injection port 57, and the inert gas is directly supplied into the feed pipe 29 via the spiral-air-flow-generating component 50. In the case where the inert gas is supplied to a space in the enclosure cover 43, the powder present in the atmosphere in the enclosure cover 43 possibly scatters. Accordingly, this embodiment can reduce the scatter of the powder in the enclosure cover 43 compared with the case of supplying the inert gas to the space in the enclosure cover 43.

For example, the spiral-air-flow-generating component 50 disposed at the intermediate portion in the longitudinal direction of the feed pipe 29 does not generate the spiral air flow at the inside of the feed pipe 29 in the inlet open end 29*a* side with respect to the spiral-air-flow-generating component 50. In this case, the powder possibly attaches to the inner wall of the feed pipe 29 in the inlet open end 29*a* side with respect to the spiral-air-flow-generating component 50. In this embodiment, the spiral-air-flow-generating component 50 is disposed on the inlet open end 29*a* of the feed pipe 29. Therefore, the spiral air flow can be generated entirely inside the feed pipe 29 and the attachment of the powder to the entire inside of the feed pipe 29 can be reduced.

In this embodiment, the inert gas is supplied into the feed pipe 29. When the plating solution accumulated in the plating solution tank 35 is maintained at a high temperature (for example, about 45° C.), steam is generated from the plating solution. This steam moves up through the inside of the feed pipe 29 and reaches the inside of the enclosure cover 43, possibly invading the feeder 30. When the steam is adsorbed onto the copper oxide powder in the feeder 30, the copper oxide powder aggregates, possibly resulting in obstruction of the feeder 30. Therefore, supplying the inert gas into the feed pipe 29 can prevent the steam from the plating solution from invading the inside of the feeder 30.

Figure 6:
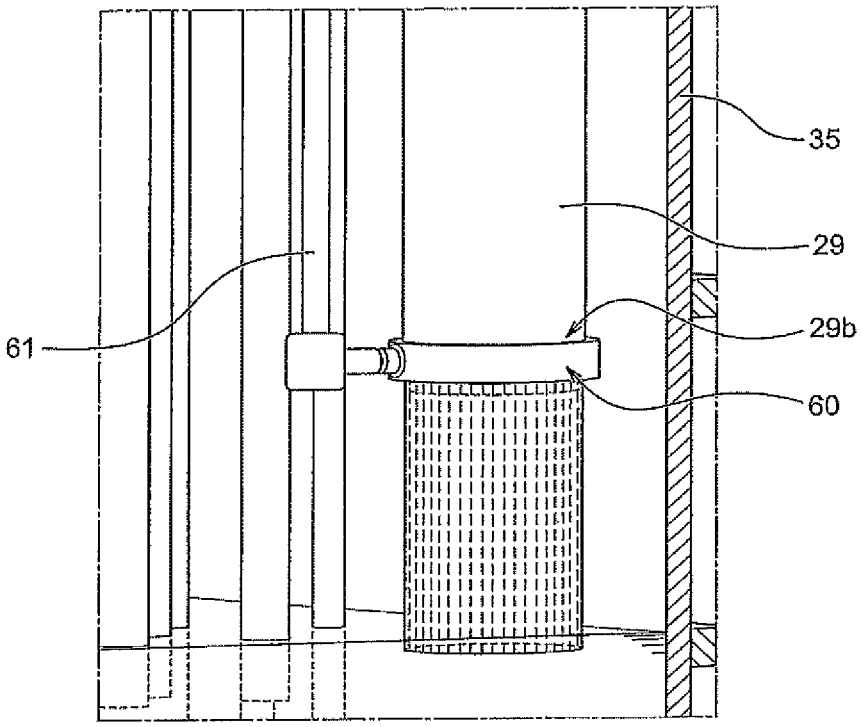
FIG. 6 is a side view illustrating an outlet open end of a feed pipe according to this embodiment.

Next, the following describes a configuration that reduces the scatter of the copper oxide powder at a proximity of the end of the feed pipe 29 on the plating solution tank 35 side. FIG. 6 is a side view illustrating the outlet open end 29*b* of the feed pipe 29 according to this embodiment. As illustrated in FIG. 6, the feed pipe 29 has the outlet open end 29*b*. When the inert gas from the inert gas supply line 44 comes out from the outlet open end 29*b* of the feed pipe 29, the inert gas diffuses due to a pressure difference between the inside and the outside of the feed pipe 29. In view of this, the copper oxide powder fed to the feed pipe 29 scatters due to the diffusion of the inert gas and possibly attaches to the wall surface of the plating solution tank 35. Therefore, as illustrated in FIG. 6, this embodiment includes a curtain generating component 60 that creates a tubular curtain of the plating solution so as to cover the outlet of the feed pipe 29. To the curtain generating component 60, a plating solution supply line 61 is connected to supply the plating solution. The plating solution supply line 61 may be, for example, connected to the plating solution return pipe 37 illustrated in FIG. 1 or may be configured such that the plating solution in the plating solution tank 35 is pumped up with a pump or the like to be supplied to the curtain generating component 60.

Figure 7A:
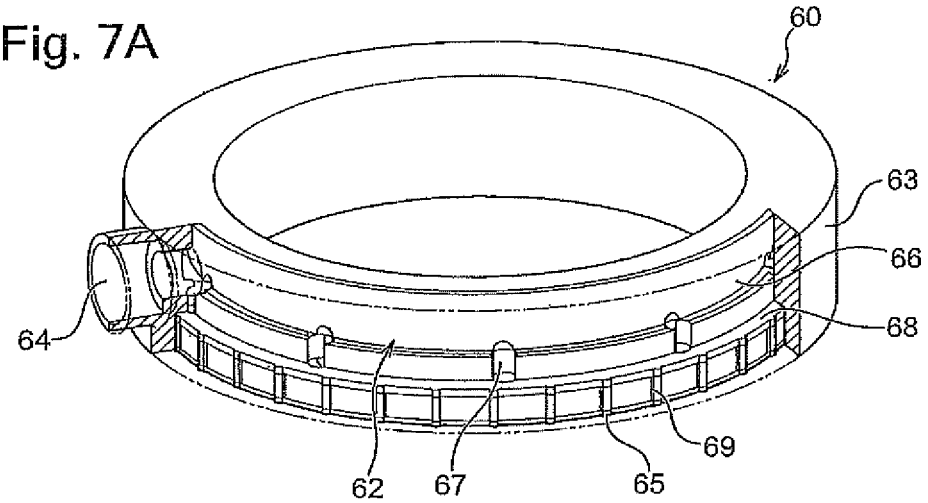
FIG. 7A is a perspective view illustrating an example of a curtain generating component.
Figure 7B:
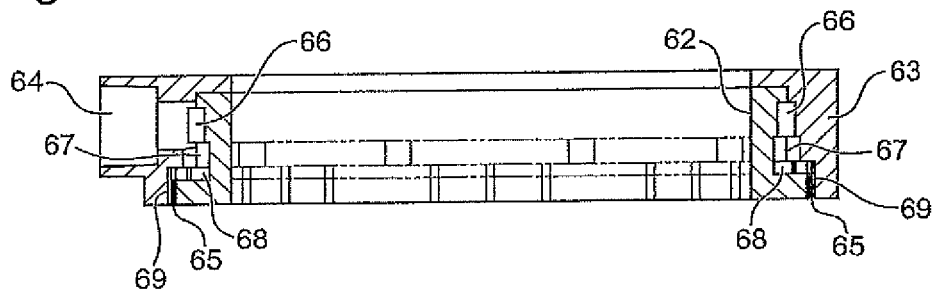
FIG. 7B is a cross-sectional side view of the curtain generating component illustrated in FIG. 7A.
Figure 7C:
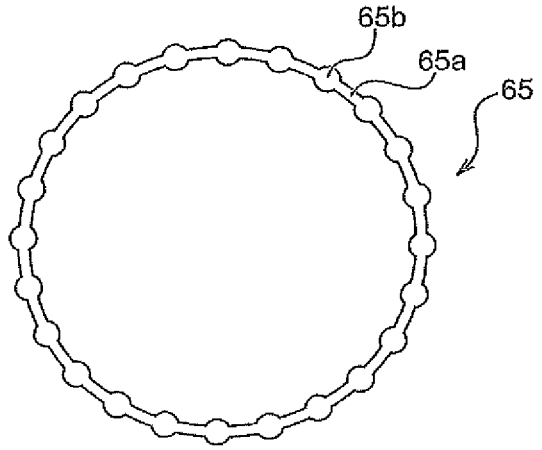
FIG. 7C is a schematic diagram illustrating a shape of a discharge port on the curtain generating component.

Next, the following describes the detailed configuration of the curtain generating component 60. FIG. 7A is a perspective view illustrating an example of the curtain generating component 60. FIG. 7B is a cross-sectional side view of the curtain generating component 60 illustrated in FIG. 7A. FIG. 7C is a schematic diagram illustrating a shape of a discharge port on the curtain generating component 60. As illustrated in FIG. 7A and FIG. 7B, the curtain generating component 60 is an annular member as a whole configured to be mounted to the outer peripheral surface of the feed pipe 29. As illustrated well in FIG. 7B, the curtain generating component 60 has a first tubular part 62 and a second tubular part 63 positioned outside the first tubular part 62. The second tubular part 63 has an inlet 64 to supply the curtain generating component 60 with the plating solution. Between the first tubular part 62 and the second tubular part 63, a discharge port 65 that discharges the plating solution in a shape of curtain is formed. Note that the inlet 64 may be formed on the first tubular part 62.

A flow passage through which the plating solution flows is formed between the inlet 64 and the discharge port 65. In this embodiment, this flow passage includes a first circumferential flow passage 66, axial flow passages 67, a second circumferential flow passage 68, and a discharge flow passage 69. The first circumferential flow passage 66 is circumferentially formed between the first tubular part 62 and the second tubular part 63 and communicates with the inlet 64. The axial flow passages 67 communicate with the first circumferential flow passage 66. In this embodiment, the plurality of axial flow passages 67 are located at approximately regular intervals along the circumferential direction of the curtain generating component 60. The second circumferential flow passage 68 is circumferentially formed between the first tubular part 62 and the second tubular part 63 and communicates with the respective axial flow passages 67. The second circumferential flow passage 68 is configured to flow the plating solution not only along the circumferential direction but also flow to the outside in the radial direction. The discharge flow passage 69 communicates with the outside in the radial direction of the second circumferential flow passage 68 and fluidly communicates between the second circumferential flow passage 68 and the discharge port 65. The axial direction here means the central axis directions of the first tubular part 62 and the second tubular part 63.

As illustrated in FIG. 7C, the discharge port 65 in this embodiment extends in the whole circumference direction between the first tubular part 62 and the second tubular part 63. In other words, the discharge port 65 has an approximately annular cross section as a whole. FIG. 7C illustrates the shape of the discharge port 65 in the cross section perpendicular to the axial direction of the curtain generating component 60. The discharge port 65 has first parts 65*a* having a first radial width and second parts 65*b* having a second radial width larger than the first radial width. Specifically, the first part 65*a* has an approximately sector shape, and the second part 65*b* has an approximately circular shape. The sector shape here means a shape surrounded by two radii of a circle and two arcs between the radii. In this embodiment, the discharge port 65 includes the plurality of first parts 65*a* and the plurality of second parts 65*b* and forms the approximately annular cross section as a whole. In other words, the discharge port 65 is configured by locating the approximately annular sectoral first parts 65*a* so as to connect the approximately circular-shaped second parts 65*b* together. As illustrated in FIG. 7C, the plurality of second parts 65*b* are preferably located at approximately regular intervals in the circumferential direction.

The following describes the function of the curtain generating component 60 illustrated in FIG. 7A to FIG. 7C. When the plating solution is supplied from the plating solution supply line 61 illustrated in FIG. 6 to the inlet 64 on the curtain generating component 60, the plating solution runs through the whole circumference of the curtain generating component 60 through the first circumferential flow passage 66. The plating solution that has run through the whole circumference subsequently moves in the axial direction through the plurality of axial flow passages 67. This changes the direction of the flow of the plating solution. Subsequently, the plating solution that has passed through the axial flow passages 67 again runs through the whole circumference of the curtain generating component 60 through the second circumferential flow passage 68. At this time, the pressure of the plating solution disperses across the whole circumference of the curtain generating component 60 to be approximately uniform. The plating solution that has reached the second circumferential flow passage 68 flows in the circumferential direction and the outside in the radial direction through the second circumferential flow passage 68 and reaches the discharge flow passage 69. The plating solution that has reached the discharge flow passage 69 generates the approximately tubular curtain of the plating solution through the discharge port 65.

With the above-described curtain generating component 60, the tubular curtain of the plating solution can be generated so as to cover the outlet of the feed pipe 29. When the copper oxide powder comes out from the feed pipe 29, this configuration allows preventing the copper oxide powder from scattering due to the diffusion of inert gas and attaching to the wall surface of the plating solution tank 35. While in this embodiment, the inert gas is supplied to the feed pipe 29, even when the inert gas is not supplied to the feed pipe 29, there is a possibility that the copper oxide powder coming out from the feed pipe 29 attaches to the wall surface of the plating solution tank 35. Specifically, for example, when the copper oxide powder collides with the plating liquid surface, there is a possibility that the copper oxide powder scatters around the peripheral area together with the plating solution and attaches to the wall surface of the plating solution tank 35. Accordingly, with the curtain generating component 60 according to this embodiment, even when the inert gas is not supplied to the feed pipe 29, the scatter of the copper oxide powder when the copper oxide powder collides with the plating liquid surface can be reduced.

The curtain generating component 60 includes the discharge port 65 having the first parts 65*a* and the second parts 65*b*. With the discharge port 65 having a simple annular shape having a constant width, it is difficult to generate the continuous curtain of the plating solution. When the discharge port 65 is configured with the plurality of axial flow passages 67 separately located along the circumferential direction, the plating solution is discharged like a shower and therefore generating the curtain of the plating solution is difficult. Since the discharge port 65 of this embodiment includes the first parts 65*a* and the second parts 65*b*, the continuous curtain of the plating solution can be stably generated. By the discharge port 65 having the plurality of second parts 65*b* at approximately regular intervals in the circumferential direction, the continuous curtain of the plating solution can be further stably generated.

Since the curtain generating component 60 of this embodiment includes the first circumferential flow passage 66 and the axial flow passages 67, while the plating solution supplied from the inlet 64 can immediately run through the curtain generating component 60 in the whole circumference direction, the flow direction of the plating solution can be changed. Since the curtain generating component 60 includes the second circumferential flow passage 68, the pressure of the plating solution can be equally dispersed across the whole circumference.

Figure 8A:
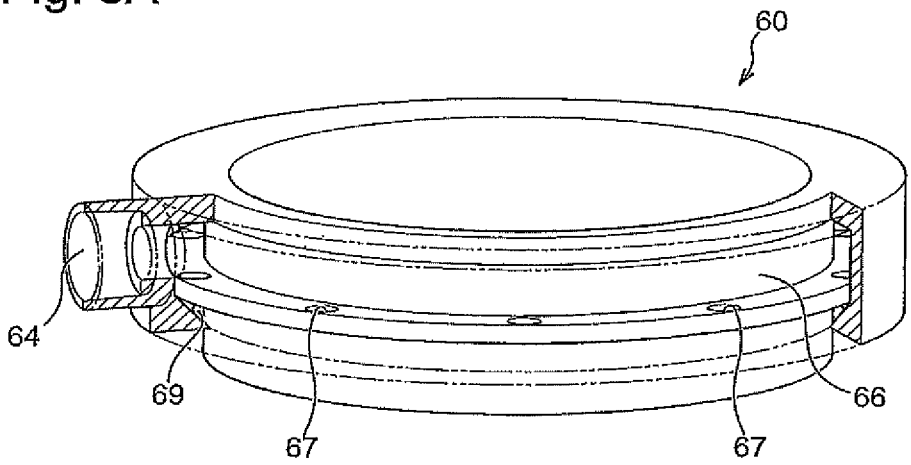
FIG. 8A is a perspective view illustrating another example of the curtain generating component.
Figure 8B:
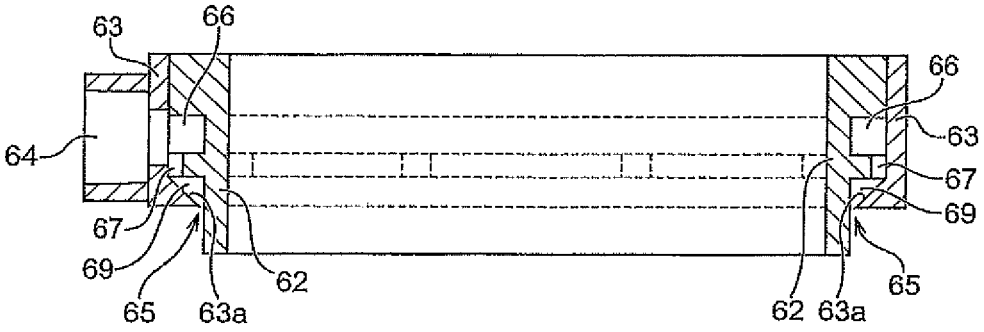
FIG. 8B is a cross-sectional side view of the curtain generating component illustrated in FIG. 8A.

Next, the following describes a modification of the curtain generating component 60. FIG. 8A is a perspective view illustrating another example of the curtain generating component 60. FIG. 8B is a cross-sectional side view of the curtain generating component 60 illustrated in FIG. 8A. As illustrated in FIG. 8A and FIG. 8B, the curtain generating component 60 of this example is an annular member as a whole and is configured to be mounted to the outer peripheral surface of the feed pipe 29, similarly to the curtain generating component 60 illustrated in FIG. 7A to FIG. 7C. As illustrated well in FIG. 8B, the curtain generating component 60 has the first tubular part 62 and the second tubular part 63 positioned outside the first tubular part 62. The second tubular part 63 has the inlet 64 to supply the curtain generating component 60 with the plating solution. Between the first tubular part 62 and the second tubular part 63, the discharge port 65 that discharges the plating solution like a curtain is formed. The inlet 64 may be formed on the first tubular part 62. The first tubular part 62 is axially longer than the second tubular part 63. Specifically, with the curtain generating component 60 mounted to the feed pipe 29, the first tubular part 62 extends to the plating solution tank 35 side (lower direction in FIG. 8A and FIG. 8B) with respect to the discharge port 65.

A flow passage through which the plating solution flows is formed between the inlet 64 and the discharge port 65. In the illustrated example, this flow passage includes the first circumferential flow passage 66, the axial flow passages 67, and the discharge flow passage 69. The first circumferential flow passage 66 is circumferentially formed between the first tubular part 62 and the second tubular part 63 and communicates with the inlet 64. The axial flow passages 67 communicate with the first circumferential flow passage 66. In the illustrated example, the plurality of axial flow passages 67 are located at approximately regular intervals along the circumferential direction of the curtain generating component 60, and the respective axial flow passages 67 communicate with the outside in the radial direction of the first circumferential flow passage 66. The discharge flow passage 69 is a flow passage that fluidly communicates between the axial flow passages 67 and the discharge port 65.

The discharge port 65 in this embodiment extends in the whole circumference direction between the first tubular part 62 and the second tubular part 63. The discharge port 65 has an approximately annular cross section as a whole and has the approximately constant a radial width (thickness of the ring). The second tubular part 63 has a tapered surface 63*a* on its inner peripheral surface. The tapered surface 63*a* is inclined such that the tapered surface 63*a* has a distance from the first tubular part 62 decreasing toward the discharge port 65. Meanwhile, the surface of the first tubular part 62 opposed to the tapered surface 63*a* of the second tubular part 63 has a constant outer diameter. Accordingly, the discharge flow passage 69 is configured to gradually narrow down toward the discharge port 65 by the tapered surface 63*a* of the second tubular part 63.

The following describes the function of the curtain generating component 60 illustrated in FIG. 8A and FIG. 8B. When the plating solution is supplied from the plating solution supply line 61 illustrated in FIG. 6 to the inlet 64 on the curtain generating component 60, the plating solution runs through the whole circumference of the curtain generating component 60 through the first circumferential flow passage 66. The plating solution that has run through the whole circumference subsequently moves in the axial direction through the plurality of axial flow passages 67. This changes the direction of the flow of the plating solution. Subsequently, the plating solution that has passed through the axial flow passages 67 reaches the discharge flow passage 69. The plating solution that has reached the discharge flow passage 69 increases the flow rate by the discharge flow passage 69, which gradually narrows down toward the discharge port 65, and is discharged from the discharge port 65. The plating solution discharged from the discharge port 65 increases the pressure by the gradually-narrowing-down discharge flow passage 69, thus generating the approximately tubular curtain of the plating solution.

With the above-described curtain generating component 60, the tubular curtain of the plating solution can be generated so as to cover the outlet of the feed pipe 29. When the copper oxide powder comes out from the feed pipe 29, this configuration allows preventing the copper oxide powder from scattering due to the diffusion of inert gas and attaching to the wall surface of the plating solution tank 35. While in this embodiment, the inert gas is supplied to the feed pipe 29, even when the inert gas is not supplied to the feed pipe 29, there is a possibility that the copper oxide powder coming out from the feed pipe 29 attaches to the wall surface of the plating solution tank 35. Specifically, for example, when the copper oxide powder collides with the plating liquid surface, there is a possibility that the copper oxide powder scatters around the peripheral area together with the plating solution and attaches to the wall surface of the plating solution tank 35. Accordingly, with the curtain generating component 60 according to this embodiment, even when the inert gas is not supplied to the feed pipe 29, the scatter of the copper oxide powder when the copper oxide powder collides with the plating liquid surface can be reduced.

The curtain generating component 60 has the tapered surface 63*a* at the second tubular part 63, and the discharge flow passage 69 gradually narrows down toward the discharge port 65. This generates the pressure in the plating solution passing through the discharge flow passage 69 in the direction heading toward the outer peripheral surface of the first tubular part 62 and therefore the flow rate and the pressure of the plating solution can be increased. Since the first tubular part 62 extends downward (plating solution tank 35 side) with respect to the discharge port 65, the plating solution discharged from the discharge port 65 flows along the outer peripheral surface of the first tubular part 62. Accordingly, the continuous curtain of the plating solution can be stably generated in the circumferential direction.

Figure 9:
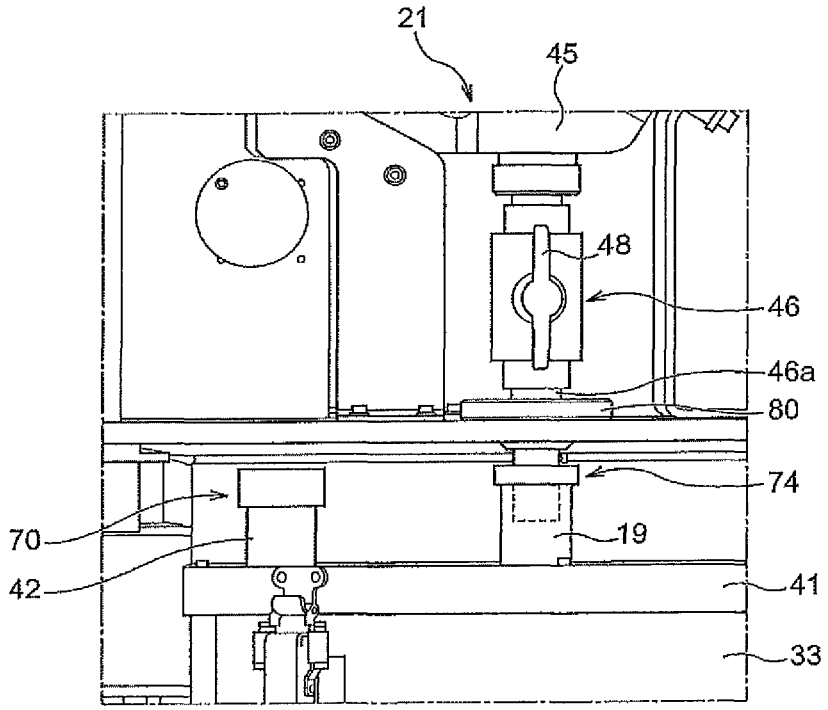
FIG. 9 is an enlarged side view near a lid of a hopper.

Next, the following describes a configuration that reduces the scatter of the copper oxide powder near the lid 41 of the hopper 33. FIG. 9 is an enlarged side view near the lid 41 of the hopper 33. When the copper oxide powder is fed from the powder container 21 to the feed port 19 of the hopper 33, the copper oxide powder possibly scatters around the outside of the hopper 33 from the clearance between the powder conduit 46 on the powder container 21 and the feed port 19. Further, when the copper oxide powder is fed into the hopper 33, there is a possibility that the copper oxide powder in the hopper 33 scatters from the exhaust port 42 around the outside of the hopper 33 together with the discharge of the gas inside the hopper 33 from the exhaust port 42. Therefore, as illustrated in FIG. 9, in this embodiment, the powder supply apparatus 20 includes a first scatter preventing component 74 and a second scatter preventing component 70. The first scatter preventing component 74 prevents the copper oxide powder from scattering from the clearance between the feed port 19 of the hopper 33 and the powder conduit 46. The second scatter preventing component 70 prevents the copper oxide powder from scattering from the exhaust port 42 of the hopper 33.

As illustrated in FIG. 9, the powder supply apparatus 20 of this embodiment includes an intermediate nozzle 80 that receives the copper oxide powder fed from the nozzle 46*a* of the powder conduit 46 and feeds the copper oxide powder to the feed port 19 of the hopper 33. In this embodiment, the first scatter preventing component 74 is disposed at the intermediate nozzle 80. In another embodiment, the copper oxide powder may be directly fed from the powder conduit 46 on the powder container 21 to the feed port 19 of the hopper 33 without the intermediate nozzle 80. In this case, the first scatter preventing component 74 is disposed at the powder conduit 46.

Figure 10:
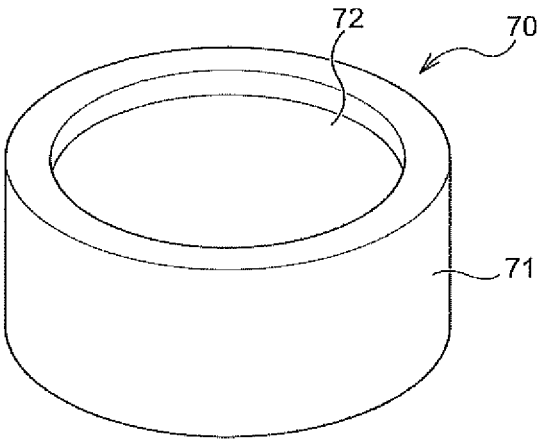
FIG. 10 is a perspective view of a second scatter preventing component.

FIG. 10 is a perspective view of the second scatter preventing component 70. As illustrated in FIG. 10, the second scatter preventing component 70 includes a filter 72 that closes the exhaust port 42 and a fixing member 71 that fixes the filter 72 to the exhaust port 42. In this embodiment, as the filter 72, any filter that can capture the copper oxide powder such as a filter cloth is employable. In this embodiment, as the fixing member 71, an approximately tubular member that presses the filter 72 against the exhaust port 42 is employed.

Figure 11:
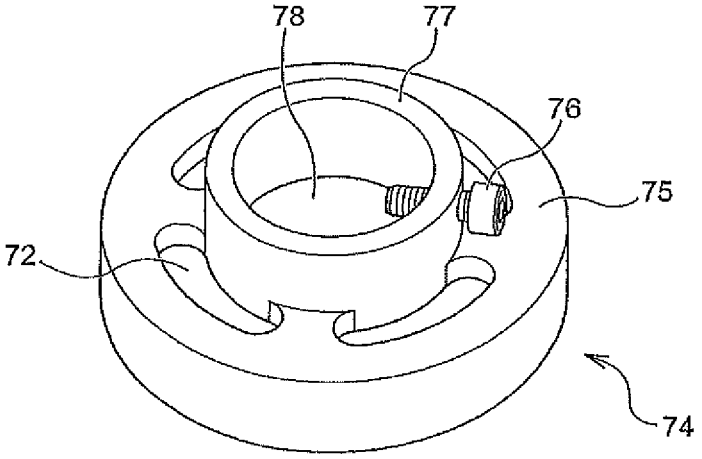
FIG. 11 is a perspective view of a first scatter preventing component.

FIG. 11 is a perspective view of the first scatter preventing component 74. As illustrated in FIG. 11, the first scatter preventing component 74 includes a tubular member 77 and a flange portion 75 that radially extends from the tubular member 77. The tubular member 77 is configured so as to fit to the powder conduit 46 or the intermediate nozzle 80. The first scatter preventing component 74 can be fixed to the powder conduit 46 or the intermediate nozzle 80 with a fixing screw 76. The flange portion 75 has a plurality of openings. In this embodiment, the flange portion 75 has the four openings. The plurality of openings are closed with the filter 72. An opening 78 is formed at the inside of the tubular member 77 and the powder conduit 46 or the intermediate nozzle 80 is inserted into the opening 78.

Figure 12:
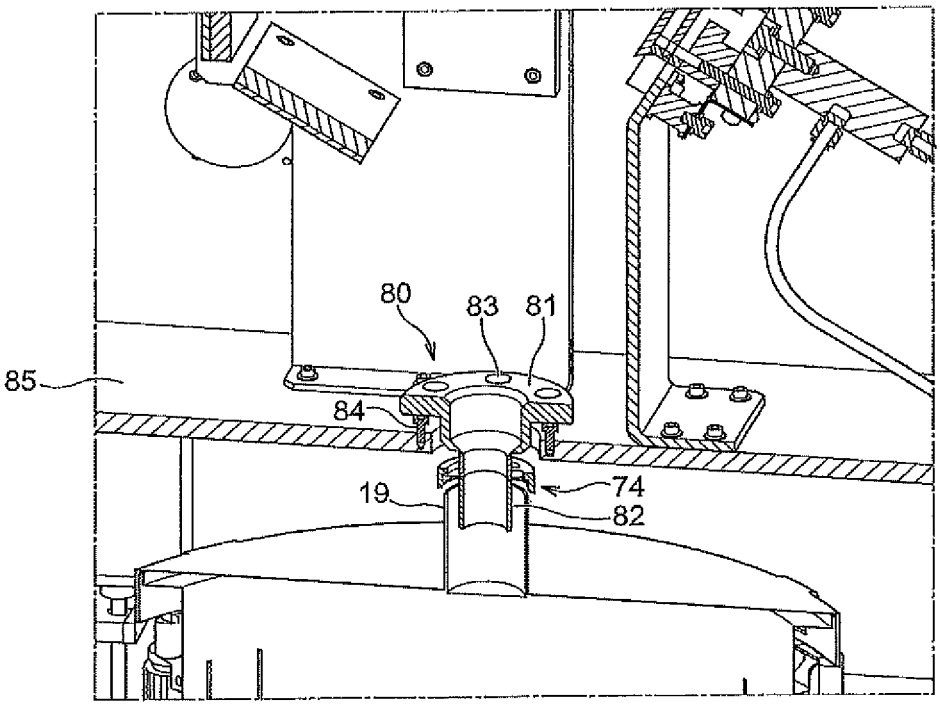
FIG. 12 is a perspective view of the hopper before the first scatter preventing component is brought into contact with a feed port of the hopper.
Figure 13:
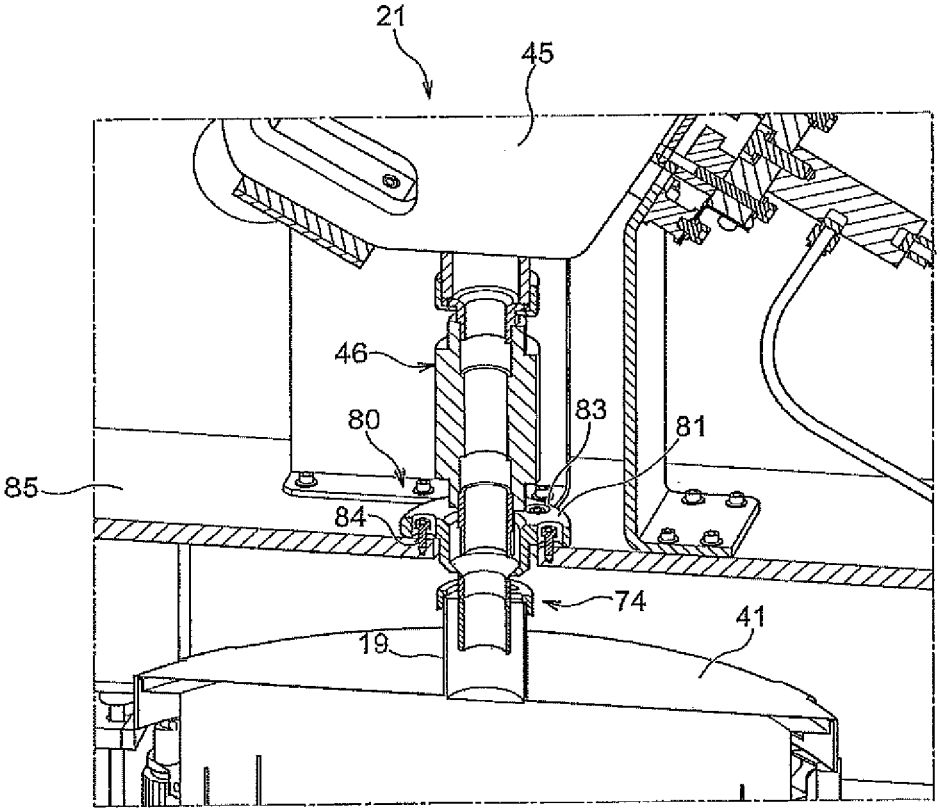
FIG. 13 is a perspective view of the hopper after the first scatter preventing component is brought into contact with the feed port of the hopper.

Next, the following describes a process of feeding the copper oxide powder from the powder container 21 to the hopper 33. FIG. 12 is a perspective view of the hopper 33 before the first scatter preventing component 74 is brought into contact with the feed port 19 of the hopper 33. FIG. 13 is a perspective view of the hopper 33 after the first scatter preventing component 74 is brought into contact with the feed port 19 of the hopper 33. As illustrated in FIG. 12, the powder supply apparatus 20 includes a horizontally extending fixing plate 85 and a plurality of bolts 84 screwed with the fixing plate 85. This fixing plate 85 is located such that the load is not applied to the weight measuring device 40 illustrated in FIG. 3.

As illustrated in FIG. 12, the intermediate nozzle 80 includes a flange portion 81 and a nozzle portion 82 (equivalent to one example of a feed nozzle) extending from the flange portion 81. The first scatter preventing component 74 is mounted to the nozzle portion 82 of the intermediate nozzle 80. The flange portion 81 has a plurality of holes 83 through which the bolts 84 are passable. In the state illustrated in FIG. 12, the plurality of bolts 84 support the flange portion 81 from the lower side and the filter 72 (see FIG. 11) of the first scatter preventing component 74 does not contact the feed port 19 of the hopper 33. Accordingly, the first scatter preventing component 74 mounted to the intermediate nozzle 80 does not contact the hopper 33 while the copper oxide powder is not fed to the hopper 33; therefore, the weights of the intermediate nozzle 80 and the first scatter preventing component 74 are not added to the weight measuring device 40 illustrated in FIG. 3.

As illustrated in FIG. 13, when the copper oxide powder is fed to the hopper 33, first, the intermediate nozzle 80 is circumferentially rotated by a predetermined angle to cause the bolts 84 to pass through the holes 83 on the flange portion 81. The intermediate nozzle 80 moves toward the hopper 33, and the first scatter preventing component 74 contacts the feed port 19 of the hopper 33. Thus, the filter 72 of the first scatter preventing component 74 prevents the copper oxide powder from scattering from a clearance between the intermediate nozzle 80 and the feed port 19 of the hopper 33.

In the case where the intermediate nozzle 80 is not disposed and the first scatter preventing component 74 is disposed at the powder conduit 46 on the powder container 21, the powder conduit 46 is inserted into the feed port 19 until the filter 72 of the first scatter preventing component 74 contacts the feed port 19 and the valve 48 (see FIG. 2) is opened. Thus, the filter 72 of the first scatter preventing component 74 prevents the copper oxide powder from scattering from the clearance between the powder conduit 46 on the powder container 21 and the feed port 19 of the hopper 33.

In another embodiment, the first scatter preventing component 74 may be preliminarily mounted to the feed port 19 of the hopper 33. In this case, the nozzle portion 82 of the intermediate nozzle 80 or the nozzle 46*a* of the powder conduit 46 of the powder container 21 is inserted into the tubular member 77 of the first scatter preventing component 74 mounted to the feed port 19 and the copper oxide powder can be fed into the hopper 33. In this case, the weights of the hopper 33 and similar member are managed including the weight of the first scatter preventing component 74 in advance.

While the above-described embodiment describes the powder supply apparatus installed different from the plating apparatus, the present invention is also applicable to the case where the copper oxide powder is directly supplied to a plating bath included in a plating apparatus. The powder containing the metal supplied to the plating solution is not limited to the copper oxide and can contain various metals such as a nickel.

The embodiment of the present invention has been described above in order to facilitate understanding of the present invention without limiting the present invention. The present invention can be changed or improved without departing from the gist thereof, and of course, the equivalents of the present invention are included in the present invention. It is possible to arbitrarily combine or omit respective constituent elements according to claims and description in a range in which at least a part of the above-described problems can be solved, or a range in which at least a part of the effects can be exhibited.

The following describes some aspects disclosed by this description.

According to a first aspect, there is provided a powder supply apparatus that supplies a powder containing a metal used for a plating to a plating solution. This powder supply apparatus includes a plating solution tank, a feed pipe, a gas supply line, and a spiral-air-flow-generating component. The plating solution tank is configured to house the plating solution. The feed pipe is configured to feed the powder into the plating solution tank. The gas supply line is configured to supply a gas. The spiral-air-flow-generating component is configured to receive the gas from the gas supply line to generate a spiral air flow heading toward the plating solution tank inside the feed pipe.

According to a second aspect, in the powder supply apparatus of the first aspect, the spiral-air-flow-generating component includes a tubular member. The tubular member has an outer surface configured to contact an inner surface of the feed pipe. The tubular member has a first end, a second end, and a groove. The first end is disposed on the plating solution tank side and the second end is disposed on a side opposite to the first end. The groove extends from the first end to the second end on the outer surface. The gas from the gas supply line is configured to pass through the groove of the tubular member.

According to a third aspect, in the powder supply apparatus of the second aspect, the groove is formed so as to be inclined with respect to an axial direction of the tubular member.

According to a fourth aspect, in the powder supply apparatus of the second or the third aspect, the spiral-air-flow-generating component further includes an air flow passage that circumferentially extends and communicates with the groove and an air injection port connected to the gas supply line and communicates with the air flow passage.

According to a fifth aspect, in the powder supply apparatus of any one of the first to the fourth aspects, the feed pipe includes an inlet open end to which the powder is fed and an outlet open end from which the powder comes out. The spiral-air-flow-generating component is disposed on the inlet open end of the feed pipe.

According to a sixth aspect, the powder supply apparatus of any one of the first to the fifth aspects further includes a hopper configured to house the powder and a feeder configured to supply the powder from an opening disposed on a lower portion of the hopper to the feed pipe.

According to a seventh aspect, there is provided a powder supply apparatus that supplies a powder containing a metal used for a plating to a plating solution. This powder supply apparatus includes a plating solution tank, a feed pipe, and a curtain generating component. The plating solution tank is configured to house the plating solution. The feed pipe is configured to feed the powder into the plating solution tank. The curtain generating component generates a tubular curtain of the plating solution so as to cover an outlet of the feed pipe.

According to an eighth aspect, in the powder supply apparatus of the seventh aspect, the curtain generating component has a first tubular part and a second tubular part positioned outside the first tubular part. A discharge port is formed between the first tubular part and the second tubular part. The discharge port discharges the plating solution. The discharge port extends between the first tubular part and the second tubular part in a whole circumference direction. The discharge port includes a first part and a second part on a cross section perpendicular to an axial direction of the curtain generating component. The first part has a first radial width. The second part has a second radial width larger than the first radial width.

According to a ninth aspect, in the powder supply apparatus of the eighth aspect, the discharge port has a plurality of the second parts. The plurality of second parts are located at approximately regular intervals in a circumferential direction.

According to a tenth aspect, in the powder supply apparatus of the seventh aspect, the curtain generating component includes a first tubular part, a second tubular part, and a discharge port. The second tubular part is positioned outside the first tubular part. The discharge port is formed between the first tubular part and the second tubular part. Between the first tubular part and the second tubular part, a discharge flow passage is formed. The discharge flow passage communicates with the discharge port to discharge the plating solution. The second tubular part has a tapered surface on an inner peripheral surface thereof. The tapered surface is inclined such that a distance from the first tubular part becomes close toward the discharge port. The discharge flow passage is configured to gradually narrow down toward the discharge port by the tapered surface of the second tubular part.

According to an eleventh aspect, in the powder supply apparatus of the tenth aspect, the first tubular part extends to the plating solution tank side with respect to the discharge port.

According to a twelfth aspect, in the powder supply apparatus of any one of the eighth to the eleventh aspects, the curtain generating component includes an inlet for the plating solution and a first circumferential flow passage that communicates with the inlet. The first circumferential flow passage circumferentially extends between the first tubular part and the second tubular part.

According to a thirteenth aspect, in the powder supply apparatus of the twelfth aspect, the curtain generating component includes a plurality of axial flow passages communicating with the first circumferential flow passage.

According to a fourteenth aspect, in the powder supply apparatus of the twelfth aspect, the curtain generating component includes a second circumferential flow passage. The second circumferential flow passage communicates with the respective axial flow passages. The second circumferential flow passage circumferentially extends between the first tubular part and the second tubular part. The second circumferential flow passage communicates with the discharge port.

According to a fifteenth aspect, in the powder supply apparatus of the thirteenth aspect, the plurality of axial flow passages communicate with the discharge flow passage.

According to a sixteenth aspect, the powder supply apparatus of any one of the seventh to the fifteenth aspects further includes a gas supply line configured to supply a gas to an inside of the feed pipe.

According to a seventeenth aspect, there is provided a powder supply apparatus that supplies a powder containing a metal used for a plating to a plating solution. This powder supply apparatus includes a plating solution tank and a hopper. The plating solution tank is configured to house the plating solution. The hopper houses the powder. The hopper includes a feed port and an exhaust port. The feed port is configured to feed the powder into the hopper. The exhaust port discharges a gas in the hopper. The powder supply apparatus further includes a first scatter preventing component and a second scatter preventing component. The first scatter preventing component is configured to prevent the powder from scattering from a clearance between the feed port and a feed nozzle. The feed nozzle is configured to feed the powder to the feed port. The second scatter preventing component is configured to prevent the powder from scattering from the exhaust port.

According to an eighteenth aspect, in the powder supply apparatus of the seventeenth aspect, the first scatter preventing component includes a filter cloth. The first scatter preventing component is mounted to the feed port or the feed nozzle.

According to a nineteenth aspect, in the powder supply apparatus of the seventeenth or the eighteenth aspect, the second scatter preventing component includes the filter cloth. The second scatter preventing component is mounted to the exhaust port.

According to a twentieth aspect, in the powder supply apparatus of any one of the seventeenth to the nineteenth aspects, the feed nozzle is a nozzle of a powder container that houses a powder.

According to a twenty-first aspect, the powder supply apparatus of any one of the seventeenth to the nineteenth aspects further includes an intermediate nozzle that receives a powder fed from a nozzle of a powder container housing the powder. The intermediate nozzle feeds the powder to the feed port of the hopper. The feed nozzle is the intermediate nozzle.

According to a twenty-second aspect, in the powder supply apparatus of the twenty-first aspect, the first scatter preventing component is mounted to the intermediate nozzle. The first scatter preventing component is configured such that when the powder is fed to the hopper, the first scatter preventing component contacts the feed port of the hopper.

According to a twenty-third aspect, there is provided a plating system. This plating system includes the powder supply apparatus, a plating bath, and a plating solution supply pipe. The powder supply apparatus is according to any one of the first to the twenty-second aspects. The plating bath is configured to plate a substrate. The plating solution supply pipe extends from the plating solution tank of the powder supply apparatus to the plating bath.

REFERENCE SIGNS LIST

2 . . . plating bath
20 . . . powder supply apparatus

29 . . . feed pipe
29*a* . . . inlet open end
29*b* . . . outlet open end
30 . . . feeder
33 . . . hopper
35 . . . plating solution tank
42 . . . exhaust port
44 . . . inert gas supply line
46 . . . powder conduit
46*a* . . . nozzle
50 . . . spiral-air-flow-generating component
51 . . . tubular member
53 . . . first end
54 . . . second end
55 . . . groove
56 . . . circumferential stepped portion
60 . . . curtain generating component
62 . . . first tubular part
63 . . . second tubular part
64 . . . inlet
65 . . . discharge port
66 . . . first circumferential flow passage
67 . . . axial flow passage
68 . . . second circumferential flow passage
69 . . . discharge flow passage
70 . . . second scatter preventing component
72 . . . filter
74 . . . first scatter preventing component
80 . . . intermediate nozzle
82 . . . nozzle portion

What is claimed is:

1. A powder supply apparatus that supplies a powder containing a metal used for a plating to a plating solution, the powder supply apparatus comprising:

a plating solution tank configured to house the plating solution;

a feed pipe configured to feed the powder into the plating solution tank;

a gas supply line configured to supply a gas; and a spiral-air-flow-generating component configured to receive the gas from the gas supply line to generate a spiral air flow heading toward the plating solution tank inside the feed pipe, wherein the feed pipe includes an inlet open end to which the powder is fed and an outlet open end from which the powder comes out, the outlet open end is positioned above a plating liquid surface of the plating solution, and the spiral-air-flow-generating component is configured to form a plurality of flow passages toward the feed pipe.

2. The powder supply apparatus according to claim 1, wherein the spiral-air-flow-generating component includes a tubular member, the tubular member having an outer surface configured to contact an inner surface of the feed pipe, the tubular member has a first end, a second end, and a groove, the first end being disposed on the plating solution tank side and the second end being disposed on a side opposite to the first end, the groove extending from the first end to the second end on the outer surface, and the gas from the gas supply line is configured to pass through the groove of the tubular member.

3. The powder supply apparatus according to claim 2, wherein the groove is formed so as to be inclined with respect to an axial direction of the tubular member.

4. The powder supply apparatus according to claim 2, wherein the spiral-air-flow-generating component further includes:

an air flow passage that circumferentially extends and communicates with the groove; and an air injection port connected to the gas supply line and communicates with the air flow passage.

5. The powder supply apparatus according to claim 1, wherein the spiral-air-flow-generating component is disposed on the inlet open end of the feed pipe.

6. The powder supply apparatus according to claim 1, further comprising:

a hopper configured to house the powder; and a feeder configured to supply the powder from an opening disposed on a lower portion of the hopper to the feed pipe.

7. A plating system comprising:

the powder supply apparatus according to claim 1;

a plating bath configured to plate a substrate; and a plating solution supply pipe that extends from the plating solution tank of the powder supply apparatus to the plating bath.

* * * * *